US009273571B2

(12) United States Patent
Dietel et al.

(10) Patent No.: US 9,273,571 B2
(45) Date of Patent: Mar. 1, 2016

(54) CAMSHAFT HAVING ADJUSTABLE CAMS THAT CAN BE OILED BY MEANS OF PRESSURE OIL

(71) Applicants: Uwe Dietel, Lichtentanne (DE); Bernd Mann, Zschopau (DE); Jürgen Meusel, Dittmannsdorf (DE)

(72) Inventors: Uwe Dietel, Lichtentanne (DE); Bernd Mann, Zschopau (DE); Jürgen Meusel, Dittmannsdorf (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 0 days.

(21) Appl. No.: 14/396,289

(22) PCT Filed: Mar. 27, 2013

(86) PCT No.: PCT/EP2013/056464

§ 371 (c)(1),
(2) Date: Oct. 22, 2014

(87) PCT Pub. No.: WO2013/160051

PCT Pub. Date: Oct. 31, 2013

(65) Prior Publication Data

US 2015/0090208 A1 Apr. 2, 2015

(30) Foreign Application Priority Data

Apr. 24, 2012 (DE) ..... 10 2012 103 581

(51) Int. Cl.
*F01L 1/34* (2006.01)
*F01L 1/047* (2006.01)
(Continued)

(52) U.S. Cl.
CPC ..... *F01L 1/047* (2013.01); *F01L 1/344* (2013.01); *F01L 13/0036* (2013.01); *F01L 2001/0473* (2013.01); *F01L 2013/0052* (2013.01); *F01L 2810/02* (2013.01)

(58) Field of Classification Search
CPC ..... F01L 1/047; F01L 1/344; F01L 13/0036; F01L 2001/0473; F01L 2013/0052; F01L 2810/02
See application file for complete search history.

(56) References Cited

U.S. PATENT DOCUMENTS 5,664,463 A * 9/1997 Amborn et al. ..... B21D 53/845 123/90.6

FOREIGN PATENT DOCUMENTS

DE 4416505 A1 11/1995
DE 19638331 A1 4/1997
(Continued)

OTHER PUBLICATIONS

German Language International Search Report for International patent application No. PCT/EP2013/056464; mailing date Jul. 22, 2013.
(Continued)

*Primary Examiner* — Zelalem Eshete
(74) *Attorney, Agent, or Firm* — ThyssenKrupp North America, Inc.

(57) ABSTRACT

The invention relates to an adjustable camshaft for the valve gear of an internal combustion engine, comprising an outer shaft, on which at least one first cam is arranged and connected to the outer shaft in a rotationally fixed manner, and an inner shaft extending through the outer shaft, to which inner shaft at least one second cam is connected in a rotationally fixed manner, wherein the second cam connected to the inner shaft in a rotationally fixed manner has a cam hole and is rotatably supported on a seating point on the outer shaft. According to the invention, at least one oil groove is introduced at the seating point in the outer shaft and/or in the inner wall of the cam hole, into which oil groove oil is guided from a gap between the outer shaft and the inner shaft through at least one passage extending through the outer shaft.

10 Claims, 6 Drawing Sheets

(51) Int. Cl.
*F01L 13/00* (2006.01)
*F01L 1/344* (2006.01)

(56) References Cited

FOREIGN PATENT DOCUMENTS

| | | | |
|---|---|---|---|
| DE | 19757504 | A1 | 7/1999 |
| DE | 102005014680 | A1 | 8/2006 |
| DE | 102008062041 | A1 | 6/2010 |
| DE | 102009039733 | A1 | 3/2011 |

OTHER PUBLICATIONS

English Translation of International Search Report for International patent application No. PCT/EP2013/056464; mailing date Jul. 22, 2013.
English Abstract of DE102009039733 A1.
English Abstract of DE102008062041 A1.
English Abstract of DE4416505 A1.
English Abstract of DE19638331 A1.
English Abstract of DE19757504 A1.
English Abstract of DE102005014680 A1.

* cited by examiner

CAMSHAFT HAVING ADJUSTABLE CAMS THAT CAN BE OILED BY MEANS OF PRESSURE OIL

CROSS REFERENCE TO RELATED APPLICATIONS

This application is a U.S. National Stage Entry of International Patent Application Serial Number PCT/EP2013/056464, filed Mar. 27, 2013, which claims priority to German patent application no. 102012103581.4, filed Apr. 24, 2012.

FIELD

The present disclosure relates to an adjustable camshaft for the valve gear of an internal combustion engine.

BACKGROUND

DE 197 57 504 B4 describes an adjustable camshaft for the valve gear of an internal combustion engine, with an outer shaft and an inner shaft which extends through the outer shaft. Cams are arranged on the outer shaft rotationally fixedly therewith, and further cams are connected rotationally fixedly to the inner shaft. Oil is conducted into the gap between the inner shaft and the outer shaft via a central bore in the inner shaft, and the oil passes into the gap between the inner shaft and the outer shaft via radially running openings from the central bore in the inner shaft.

DE 10 2005 014 680 A1 shows a further adjustable camshaft for the valve gear of an internal combustion engine, with an outer shaft on which at least one first cam is arranged and connected rotationally fixedly thereto, and with an inner shaft which extends through the outer shaft and to which at least one second cam is connected rotationally fixedly. In order to deliver oil for lubrication into the gap between the inner shaft and the outer shaft, a supply channel is shown in the outer shaft for example, located in a portion of the outer shaft into which the inner shaft does not extend. Thus oil can reach into the gap between the inner shaft and the outer shaft through a filter, shown as an example, wherein for example an oil injection nozzle may be used as an oil supply device.

By the introduction of oil into the gap between the inner shaft and the outer shaft, reliable lubrication can be ensured between the inner shaft and the outer shaft, but the bearing arrangement of the second cam connected to the inner shaft on the outside of the outer shaft may not be supplied with sufficient lubricating oil. This inadequate oiling state of the rotatable cam arranged on the outer shaft can result in increased wear, in particular below the cam crown, which can lead to premature failure of the camshaft. This can be remedied by hardening the surface of the outer shaft in order to prevent the abrasion of the surface, wherein the hardening of the surface is however associated with great technical complexity and entails further costs.

SUMMARY

The object of the present invention is therefore to provide an adjustable camshaft for the valve gear of an internal combustion engine with minimized wear, in particular with the task of creating an improved oil supply of the bearing arrangement of the second cam connected to the inner shaft, on the outside of the outer shaft.

Disclosed herein is an adjustable camshaft for the valve gear of an internal combustion engine, with an outer shaft on which at least one first cam is arranged and connected rotationally fixedly thereto, and with an inner shaft which extends through the outer shaft and to which at least one second cam is connected rotationally fixedly, wherein the second cam connected rotationally fixedly to the inner shaft has a cam bore and is mounted rotatably at a seating point on the outer shaft.

Adjustable camshafts for the valve gear of internal combustion engines, with cams which are adjustable in their phase position relative to each other, allow the inlet valves and exhaust valves of the internal combustion engine to be controlled with different timings without the necessity for an inlet camshaft for the inlet valves and a separate exhaust camshaft for the exhaust valves. The coaxial shafts rotate about a common rotation axis in the cylinder head and can be adjusted to their relative phase positions via a control element. A gap is formed between the outside of the inner shaft and the inside of the tubular outer shaft, and the camshaft is configured to conduct pressure oil into the gap for lubrication thereof.

DETAILED DESCRIPTION

Figure 1:
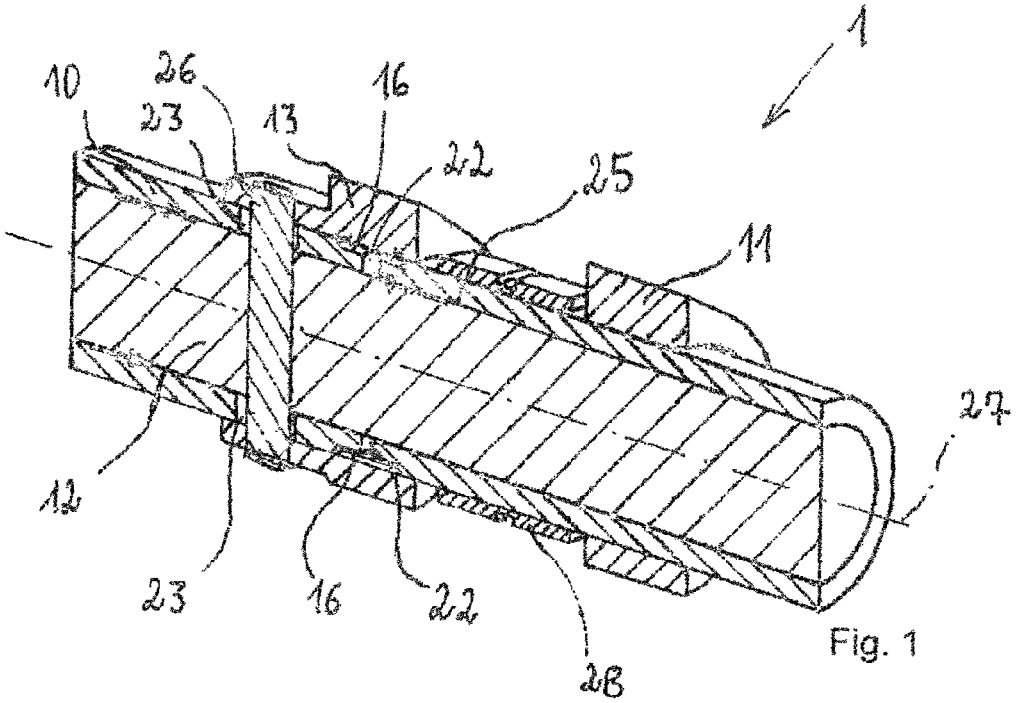
FIG. 1 is a perspective section view of an embodiment of a longitudinally sectioned camshaft of the present disclosure, having passages defined in an outer shaft which are designed as separate single bores.

The invention includes the technical teaching that at least one oil groove is made at the seating point on the outer shaft and/or in the inner wall of the cam bore, in which groove oil is conducted from a gap between the outer shaft and inner shaft through at least one passage extending through the outer shaft.

The invention advantageously uses the possibility of supplying the plain bearing of the cam on the outside of the outer shaft with oil from the gap between the inner shaft and the outer shaft. Since the oil in the gap between the inner shaft and the outer shaft is in principle conducted under pressure through the gap, because of the positive pressure, oil can enter the passage in the outer shaft in order finally to lubricate the arrangement of the second cam on the outer shaft which is formed as a plain bearing.

Due to the positive pressure, through the passage in the outer shaft, oil can enter the at least one oil groove which is arranged at the seating point in the outer shaft and/or in the inner wall of the cam bore, so that the oil which is conducted through the passage in the oil groove enters the lubrication gap between the outer shaft and the cam bore. Thus a lubrication arrangement is created as used in hydrostatic plain bearings, and the oil conveyed with at least a slight positive pressure into the oil groove automatically enters the lubrication gap between the outer shaft and the cam bore.

The second cam can be connected to the inner shaft via a bolt which, on rotation of the inner shaft, also pivots in relation to the outer shaft. Consequently a bolt opening produced linearly at least in the circumferential direction is provided in the outer shaft, and the passage for conduction of the oil from the gap between the inner shaft and the outer shaft on the at least one oil groove can be formed by the bolt opening itself. Additionally or alternatively, a passage can be provided as a single bore which extends through the outer shaft and opens in the seating point for arrangement of the second cam. The single bore here extends radially through the outer shaft and the oil can travel from the gap between the inner shaft and outer shaft into the plain bearing of the second cam on the outside of the outer shaft.

The oil can be provided in the peripheral gap between the inner shaft and the outer shaft, as known from DE 197 57 540 B4, via an axial central bore and separate radial bores branching therefrom which may overlap with the radial passage designed as a single bore in the outer shaft. Furthermore there is a possibility that the bore in the inner shaft which holds the bolt has at least one bypass, through which oil can reach from the axial central bore into the gap between the inner shaft and the outer shaft. If the oil is supplied through a central bore, the bolt can also be designed as two pieces with a central interruption, so that the bolt does not interrupt an axial oil flow through the central bore.

According to a further advantageous exemplary embodiment, the oil groove made at the seating point in the outer shaft can be designed fluidically communicating with the passage, wherein the passage in particular is the bolt opening for guidance of the bolt through the outer shaft. Thus the oil can reach the oil groove directly through the passage, wherein the second cam can extend in width beyond the passage. For this the second cam can be designed as a collar cam with a cam collar, and the cam collar extends as a portion of the cam body beyond the passage in the outer shaft, and for example the bolt can be inserted in the cam collar between the inner shaft and the second cam. If now oil travels through the passage from the gap between the inner shaft and outer shaft, said passage is again placed under oil pressure and the oil can still reach the oil groove which is conducted to the passage and is thus designed fluidically communicating therewith.

Further advantageously, the oil groove can be formed as a widened part or widened region of the bolt opening. For example the bolt opening can have both a linear extension in the circumferential direction of the outer shaft and also a linear extension in the direction towards the rotation axis of the camshaft. Thus a degenerated oil groove is formed which is designed integrally with the correspondingly enlarged and for example approximately rectangular bolt opening.

The oil groove, which may be made in the outside of the outer shaft or in the inner wall of the cam bore of the second cam, can in its longitudinal extension run parallel to the rotation axis of the camshaft, or the oil groove runs obliquely to the rotation axis. In particular the oil groove can be designed such that the sliding gap between the outer shaft and the cam bore in the cam is supplied with pressure oil not only at one position. For example an oil groove running in the circumferential direction can be made in the outer shaft and/or in the cam bore. The groove running in the circumferential direction can for example communicate fluidically with at least one oil groove running linearly or obliquely to the rotation axis, for example the oil groove can transform into the oil groove running in the circumferential direction. If a first oil groove is supplied with oil from the gap between the inner shaft and the outer shaft, the oil first travels through the passage in the outer shaft into the first oil groove and from there into the further oil groove running in the circumferential direction. Evidently the oil groove in the sense of the invention can also be formed directly by the oil groove running in the circumferential direction, which is then supplied with oil directly from the passage in the outer shaft, without the interposition of at least one first groove running linearly or transversely to the rotation axis.

The oil can be pressed into the gap between the outer shaft and inner shaft under pressure, in particular the pressure oil can flow along the longitudinal direction of the rotation axis or the oil can be conducted into the gap from a central bore in the inner shaft and via at least one radial channel in the inner shaft. For example, the oil supply to the gap can be designed as in DE 197 57 504 B4.

The second cam can have a cam collar into which the oil groove can extend at least partly. The cam collar may form a cylindrical extension to a side face of the second cam, so that due to the greater width, the contact surface is enlarged to form the plain bearing between the outer shaft and the cam bore. The bolt for connecting the second cam to the inner shaft can preferably be introduced into the cam collar, so that also the bolt opening in the outer shaft is preferably arranged, in relation to the seating point, in the portion of the cam bore which is formed by the cam collar. Consequently the oil groove can extend in particular into the cam collar, so that the oil from the bolt opening passes into the oil groove which extends at least from the region of the cam collar into the region of the cam bore which lies below the actual cam. Particularly advantageously, the oil groove can be made at the position in the cam bore which lies below the cam crown, since an oil supply is particularly necessary at this position to lubricate the sliding gap. Also several oil grooves can be provided at the seating point of the outer shaft and/or in the cam bore, for example a bolt for connection of the second cam to the inner shaft may extend through two bolt openings lying opposite each other in the outer shaft, and oil can enter the respectively assigned oil groove through each bolt opening.

FIG. 1 shows a portion of an adjustable camshaft 1 in a cross section view. The camshaft 1 is used for the valve gear of an internal combustion engine and has a tubular outer shaft 10. An inner shaft 12 extends through the outer shaft 10 so that a peripheral gap 25 is formed between the inner shaft 12 and the outer shaft 10. The gap 25 is formed round the entire circumference between the outer shaft 10 and the inner shaft 12, and pressure oil is pressed into the gap 25 in a manner not shown in detail, as indicated by arrows. The oil can flow along the gap 25 and ensure the lubrication between the outer shaft 10 and inner shaft 12.

First cams are arranged on the outer shaft 10, of which a first cam 11 is shown as an example. For example an exhaust valve of the internal combustion engine may be controlled by the first cam 11. Furthermore second cams are arranged on the outer shaft 10, of which one second cam 13 is shown as an example. The first cam 11 is connected rotationally fixedly to the outer shaft 10, for example by being pressed onto the outer shaft 10 or by being connected to the outer shaft 10 by a material joining process. The second cam 13 is connected rotationally fixedly to the inner shaft 12, and when the inner shaft 12 is turned in its phase position in relation to the outer shaft 10, at the same time the second cam 13 is turned in relation to the first cam 11. The adjustable camshaft 1 can rotate about its rotation axis 27, wherein the angular position of the outer shaft 10 can be adjusted in relation to the angular position of the inner shaft 12. If the first cam for example cooperates with an exhaust valve and the second cam 13 for example with an inlet valve, the timing of the inlet valve can be changed in relation to the timing of the exhaust valve by changing the angular position of the second cam 13 in relation to the first cam 11. A bearing ring 28 is also shown which is arranged firmly seated on the outside of the outer shaft 10.

In order to connect the second cam 13 rotationally fixedly to the inner shaft 12, bolt 26 is used which extends through the inner shaft 12 transversely to the rotation axis 27. The bolt 26 is connected at its end to the second cam 13. The bolt 26 extends through bolt openings 23 which each form passages in the outer shaft 10. The bolt openings 23 are formed linearly in the circumferential direction of the outer shaft 10, so that the bolt 26 can pivot in the linear bolt openings 23 when the inner shaft 12 is adjusted in its phase position in relation to the outer shaft 10 about rotation axis 27. For this, the second cam 13 is mounted on a plain bearing on the outer shaft 10 and thus pivots with the inner shaft 12, sliding on the outer shaft.

According to the exemplary embodiment shown, the outer shaft 10 is designed with passages 22 which are formed as separate passages and which lie in the region of the outer shaft 10 on which the second cam 13 is held rotatably. Through the passages 22, the pressure oil can pass from the gap 25 between the inner shaft 12 and the outer shaft 10 and enter the oil grooves 16 which are made in the outer shaft 10 at the seating point of the second cam 13. This creates a hydrostatic lubrication effect of the plain bearing gap of the second cam 13 on the outside of the outer shaft 10. Then the pressure oil can emerge laterally from the sliding gap of the second cam 13 and the outer shaft 10. The pressure oil introduced into the bearing gap of the second cam 13 and the outer shaft 10 minimizes the wear on the seating point at which the second cam 13 is arranged on the outer shaft 10. In particular due to the periodic pressure loading of the cam 13 by contact of the cam crown with a take-off element, an increased wear occurs which can be minimized by the improved lubrication.

Figure 2:
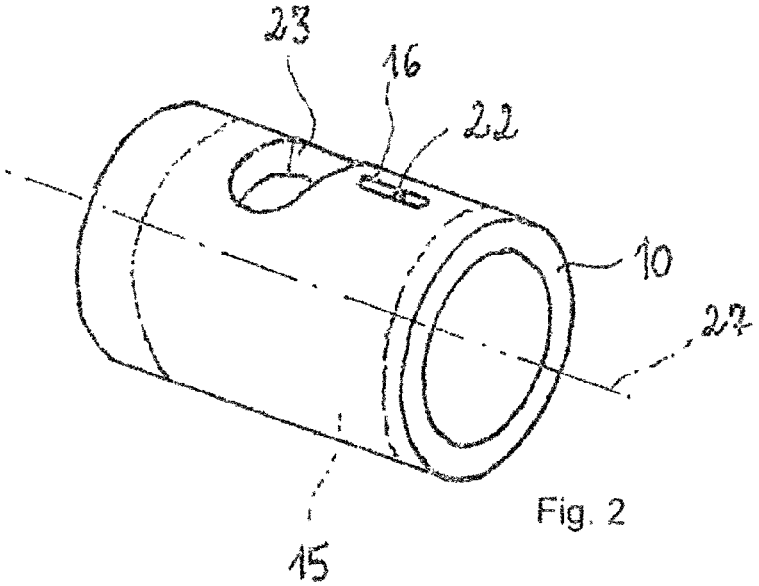
FIG. 2 is a perspective view of the outer shaft of the camshaft of FIG. 1, as disclosed herein.

FIG. 2 shows a perspective view of a portion of the outer shaft 10, according to the exemplary embodiment in FIG. 1, in which a passage 23 is made which serves as a bolt opening 23 for passage of the bolt 26. A passage 22 is also shown which is formed separately from the bolt opening 23 and opens in an oil groove 16 which is made in the outside of the outer shaft 10 and which extends along the rotation axis 27. The oil groove 16 is arranged in the outer shaft 10 in the region of the seating point 15 in which the second cam 13 is arranged, and has a correspondingly great need for lubricating oil.

Figure 3:
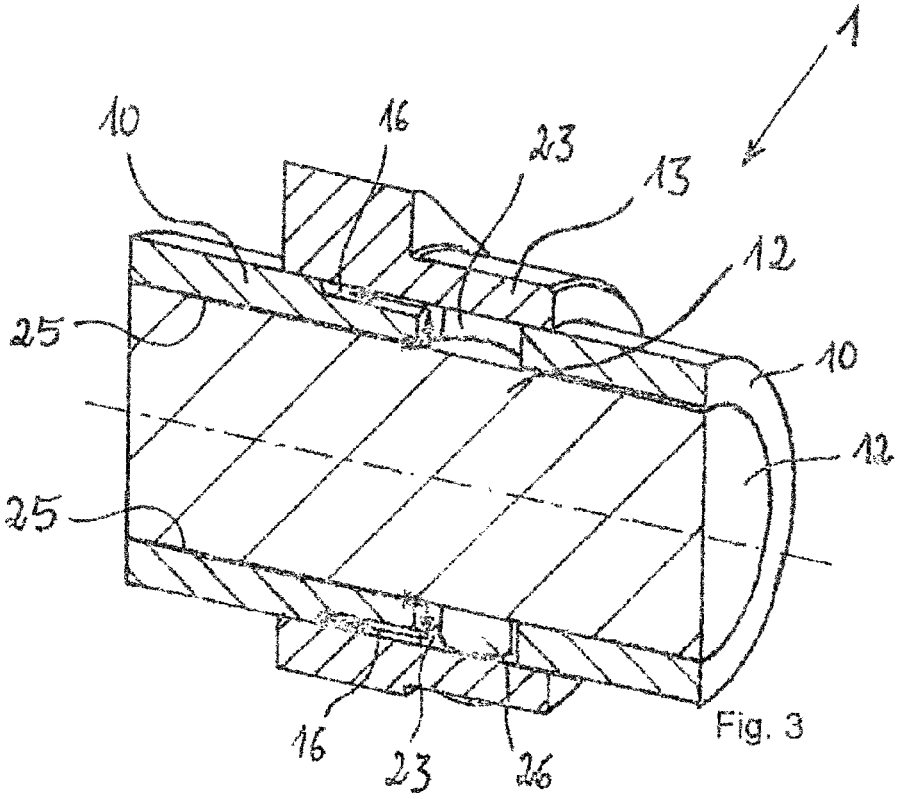
FIG. 3 is a perspective section view of an alternate embodiment of an adjustable camshaft of the present disclosure, having passages defined in an outer shaft which are formed by bolt openings.

FIG. 3 shows an exemplary embodiment of an adjustable camshaft 1 with an outer shaft 10 and an inner shaft 12, wherein as an example only one second cam 13 is shown which is connected rotationally fixedly to the inner shaft 12 via the bolt 26. For passage of the bolt 26, the outer shaft 10 has two bolt openings 23, and according to the exemplary embodiment shown, pressure oil can travel from the gap 25 through the bolt openings 23 into the oil grooves 16, so that the bolt opening 23 already serves as a passage 23 for supplying oil to the oil groove 16, without requiring separate passages in the outer shaft 10.

Figure 4:
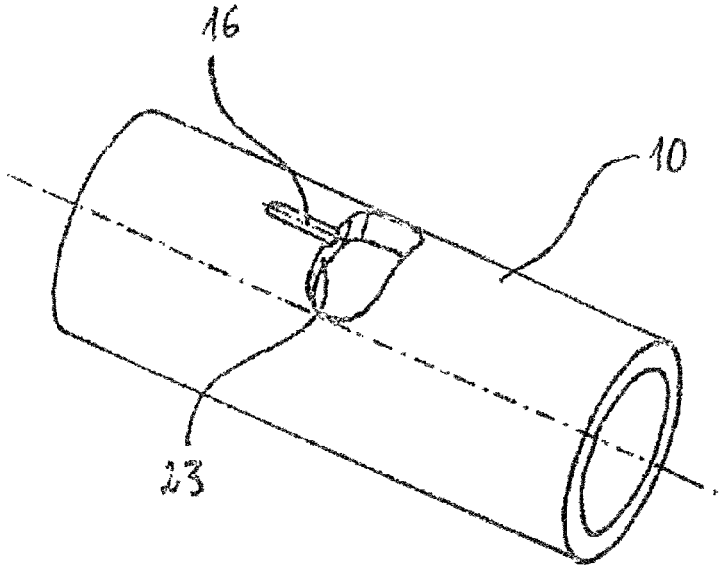
FIG. 4 is a perspective view of the outer shaft of the camshaft of FIG. 3, as disclosed herein.

FIG. 4 shows in a perspective view a portion of the outer shaft 10 according to the exemplary embodiment of FIG. 3, and the groove 16 is brought to the edge of the bolt opening 23 so that it serves as a passage 23 for oil supply to the oil groove 16. The arrangement shown of the oil groove 16 with the bolt opening 23 can also be present on the opposite side in the outer shaft 10, as shown in FIG. 3.

Figure 5:
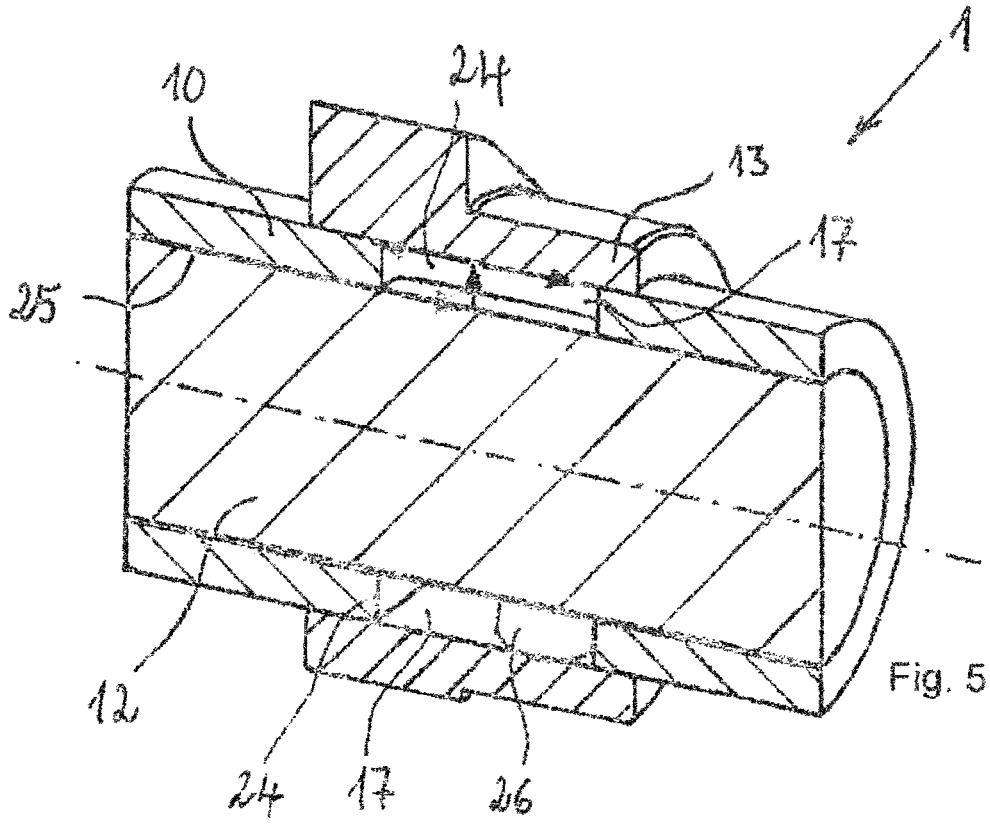
FIG. 5 is a perspective section view of an alternate embodiment of an adjustable camshaft of the present disclosure, having an outer shaft in which enlarged bolt openings are defined which also serve as oil grooves.

FIG. 5 shows a portion of a further exemplary embodiment of a camshaft 1 with an outer shaft 10 and an inner shaft 12, wherein again only one second cam 13 is shown as an example. The second cam 13 is connected rotationally fixedly to the inner shaft 12 via the bolt 26, wherein the bolt 26 passes through the outer shaft 10 with both ends through respective bolt openings 24. The bolt openings 24 in this exemplary embodiment also serve as passages 24 through which pressure oil can pass from the gap 25 into the sliding gap between the outer shaft 10 and the second cam 13. The bolt opening 24 is selected in its dimensions such that a first region of the bolt opening 24 serves for passage of the bolt 26, and a further region of the bolt opening 24 serves as an oil groove 17 for distributing the pressure oil into the sliding gap between the outer shaft 10 and the cam 13. The enlarged bolt opening 24 consequently forms a degenerated oil groove 17, since the bolt opening 24 extends to below the second cam 13.

Figure 6:
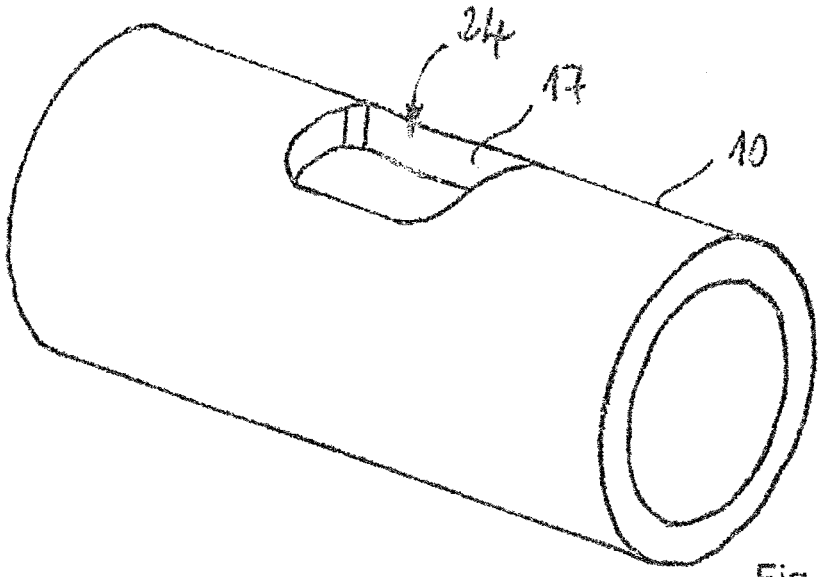
FIG. 6 is a perspective view of the outer shaft of the camshaft of FIG. 5, as disclosed herein, showing an enlarged bolt opening defined therein.

FIG. 6 shows a perspective view of a portion of the outer shaft 10 with a bolt opening 24, according to the exemplary embodiment in FIG. 5, which also forms the oil groove 17 so that the larger dimensioned bolt opening 24 serves both for passage of the bolt and to form an oil groove 17 for oil supply.

Figure 7:
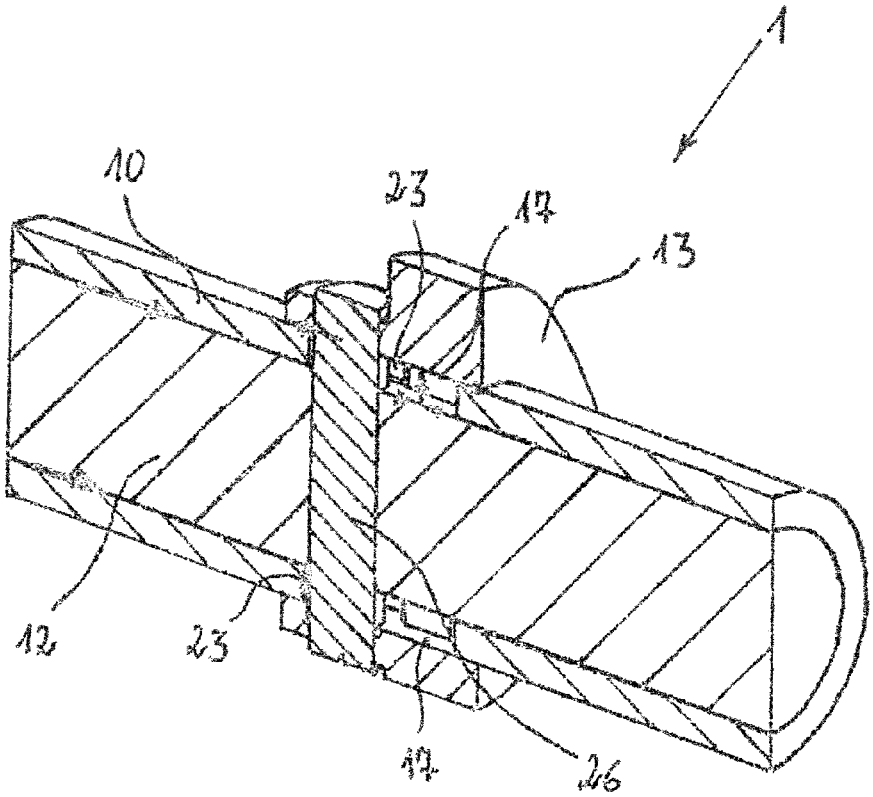
FIG. 7 is a perspective section view of an alternate embodiment of an adjustable camshaft of the present disclosure having bolt openings defined therein, wherein an oil groove is formed as a side pocket in the respective bolt openings.

FIG. 7 shows a further exemplary embodiment of an adjustable camshaft 1 with an outer shaft 10 and an inner shaft 12, and a bolt 26 is passed through passages 23 in the outer shaft 10. An oil groove 17 is shown which stands in direct fluidic contact with the passage 23 and which is formed as a lateral pocket-like recess of the bolt opening 23. The oil groove 17 thus formed extends to below the second cam 13 so that the pressure oil passes via the bolt opening 23 and the oil groove 17 into the sliding gap between the outer shaft 10 and the second cam 13.

Figure 8:
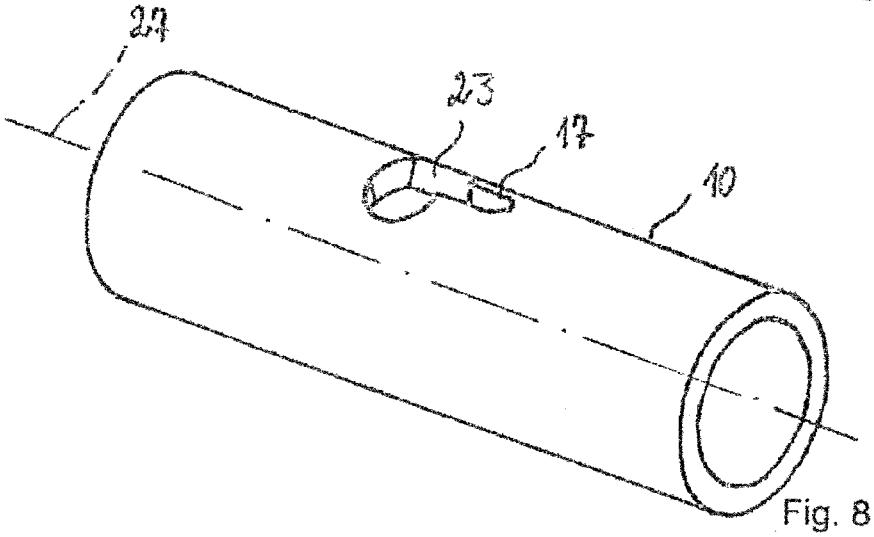
FIG. 8 is a perspective view of the outer shaft of the camshaft of FIG. 7, as disclosed herein, having an oil groove formed as a pocket in the bolt opening.

FIG. 8 shows a perspective view of a portion of the outer shaft 10 with a bolt opening 23 according to the exemplary embodiment in FIG. 7, and the oil groove 17 is produced in the edge of the bolt opening 23 as a pocket-like recess which forms a bulge in the bolt opening in the direction running towards the rotation axis 27.

Figure 9:
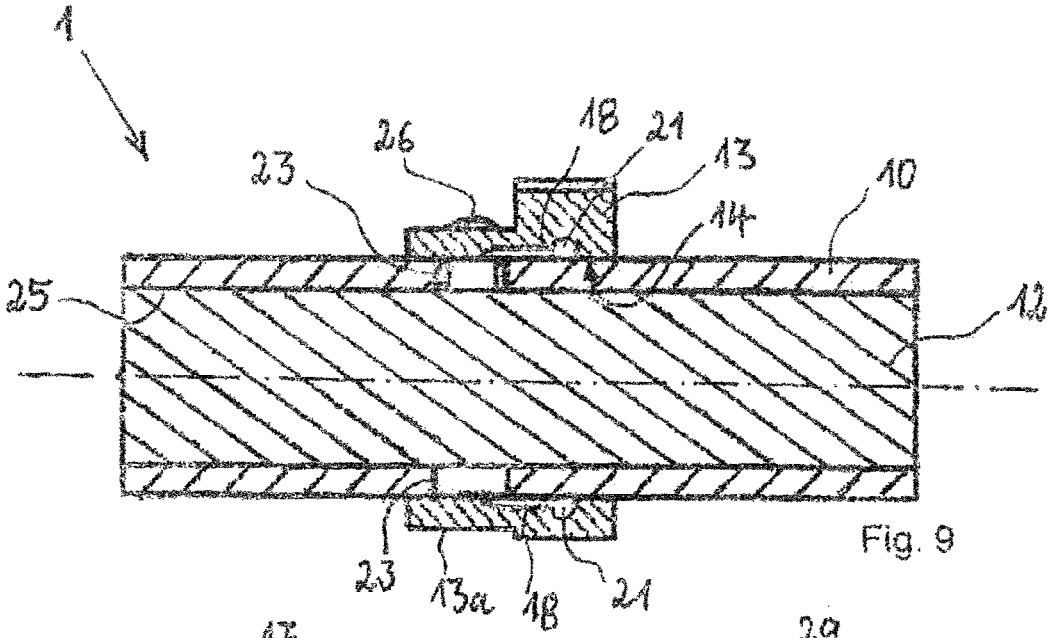
FIG. 9 is a side cross section view of an embodiment of an adjustable camshaft of the present disclosure, having oil grooves defined in the cam bore of the cam.

FIG. 9 shows a further exemplary embodiment of an adjustable camshaft 1 in a cross section view, wherein the cam 13 is connected to the inner shaft 12 via the bolt 26 and mounted on the outside of the outer shaft 10. An oil groove 18 lies adjacent to the bolt opening 23 and is made in the inside of the cam bore 14 of the second cam 13. No oil groove is made for example in the outside of the outer shaft 10, wherein the exemplary embodiment of the second cam 13 shown, with an oil groove 18 made in the cam bore 14, may be combined with an oil groove 16 made in the outer shaft 10 as shown above and/or the oil groove 17.

The second cam 13 is designed with a cam collar 13*a* in which the bolt 26 is inserted. The oil groove 18 protrudes at least with one portion over the bolt opening 23, so that the pressure oil can pass from the gap 25 via the bolt opening 23 into the oil groove 18 made in the cam bore 14. The exemplary embodiment furthermore shows an oil groove 21 which is made circumferentially in the cam bore 14, as shown in more detail in FIG. 10*c*. If pressure oil passes via the groove 18 into the oil groove 21, the plain bearing between the outer shaft 10 and the cam bore 14 can be supplied evenly with oil over the full periphery.

Figure 10A:
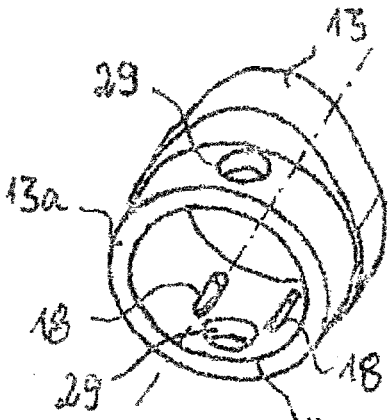
FIG. 10*a* is a perspective view of an embodiment of a cam having a cam collar and oil grooves defined in the cam bore, as disclosed herein.

FIG. 10*a* shows in a perspective view a second cam 13 with a cam collar 13*a*, which thus forms a so-called collar cam. The cam collar 13*a* serves to receive the bolt 26, for which reason bolt bores 29 are made therein. Oil grooves 18 extending in the longitudinal axis are produced in the inside of the cam bore 14 adjacent to the bolt bores 29. Due to the arrangement of the oil grooves 18 adjacent to the bolt bores 29, similarly an arrangement is produced of the oil grooves 18 adjacent to the bolt opening 23 when the second cam 13 is arranged on the outer shaft 10. Consequently the pressure oil can pass through the bolt opening 23 into the oil grooves 18, which can run in the direction towards the longitudinal axis of the cam 13 from the cam collar 13*a* down to below the actual cam region.

Figure 10B:
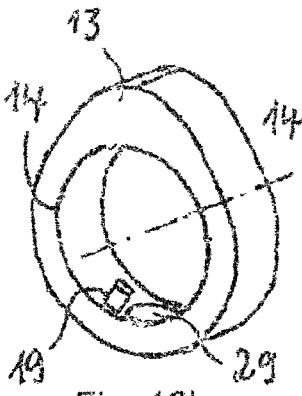
FIG. 10*b* is a perspective view of an embodiment of a cam without a cam collar, wherein an oil groove is shown in a cam bore, as disclosed herein.

FIG. 10*b* shows a variant of a second cam 13 without cam collar 13*a*, and as an example an oil groove 19 is provided which is made in the inner wall of the cam bolt 14 adjacent to the bolt bore 29. Cams 13 of this type can also be connected by a bolt to the inner shaft 12, wherein the bolt can be introduced in a continuous hole in the cam flange and an internal blind bore below the cam crown.

Figure 10C:
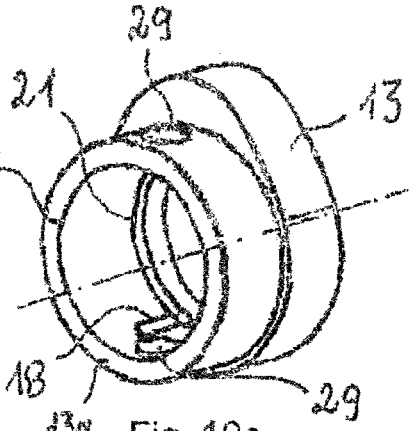
FIG. 10*c* is a perspective view of an embodiment of a cam having a cam collar and an oil groove defined in the cam bore, which oil groove runs in a circumferential direction of the cam bore and is in fluid communication with at least another oil groove defined in a longitudinal direction of the cam bore.

FIG. 10*c* finally shows a further cam 13 with a cam collar 13*a*, and an oil groove 18 is shown adjacent to the bolt bore 29. Furthermore a circumferential oil groove 21 is made in the cam bore 14 which is in fluidic connection with the oil groove 18 running in the longitudinal direction. If pressure oil is pressed into the peripheral oil groove 21 via the oil groove 18, an improved oil supply around the entire periphery of the bearing gap can be ensured to lubricate the cam 13 on the outer shaft.

Figure 11:
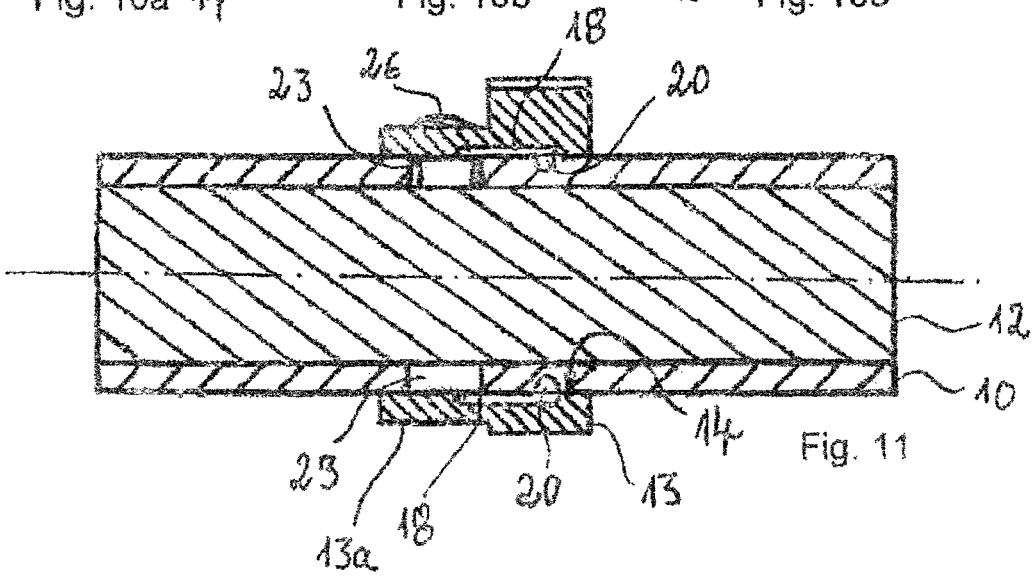
FIG. 11 is a side cross section view of an embodiment of an adjustable camshaft of the present disclosure having an outer shaft with a circumferential oil groove defined therein.

FIG. 11 shows an exemplary embodiment of a camshaft 1 with an outer shaft 10 and an inner shaft 12, and in the manner already described a second cam 13 with a cam collar 13*a* is connected rotationally fixedly to the inner shaft 12 via bolts 26. Oil grooves 18 are made in the cam bore 14 and extend from the cam region into the cam collar 13*a*. The oil grooves 18 overlap the bolt openings 23 in the outer shaft 10 and can thus be supplied with pressure oil. The exemplary embodiment furthermore shows an oil groove 20 located in the outside of the outer shaft 10 and running in the circumferential direction. The oil groove 20 can be supplied with pressure oil via the oil groove 18, and also several oil grooves 18 can be arranged which are distributed on the periphery of the cam bore 14 and transport the oil from the oil groove 20 into the lubrication gap between the outer shaft 10 and the cam 13.

To further improve the oiling of the sliding gap between the outside of the outer shaft 10 and the cam bore 14, for example structuring can be provided in the cam bore 14, for example by bombardment with glass beads or other particles or by laser structuring, to form a reservoir for the oil conducted below the cam 13. The structuring here can have a prism-like or cap-like shape. The oil groove 18 may be open towards the face of the cam 13 or may end therein, but it is preferred if the oil groove 18 is closed, with the advantage that it is more difficult for the oil to flow out of the groove 18. The same applies to the oil grooves 16 running along the outer shaft 10.

Figure 12:
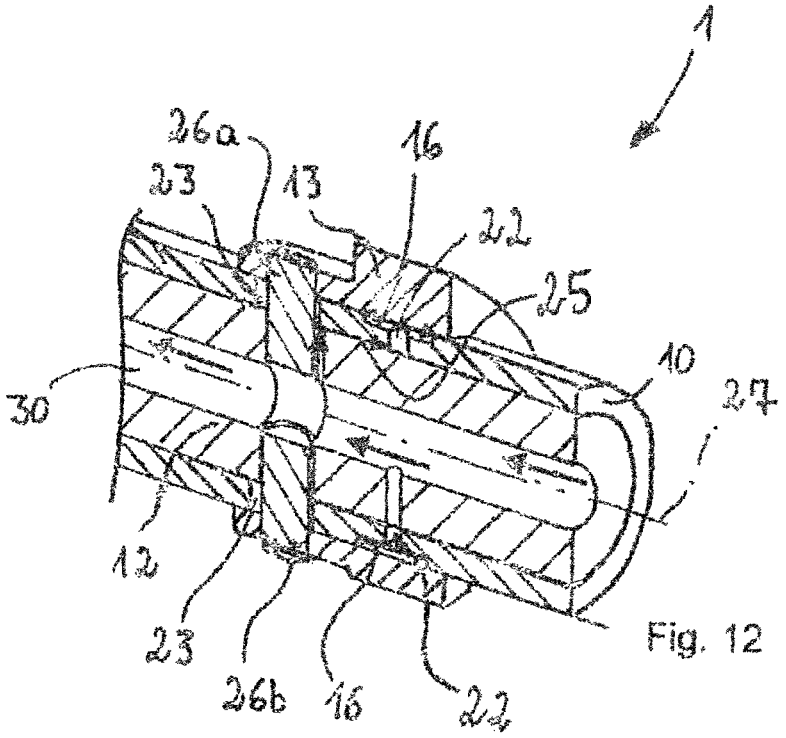
FIG. 12 is a perspective section view of an alternate embodiment of an adjustable camshaft having an inner shaft with an central oil supply channel defined there through, as disclosed herein.

FIG. 12 shows, in a cross section part view, an exemplary embodiment of the camshaft 1 with an inner shaft 12 in which a central channel 30 is provided for oil supply, extending along the rotation axis 27. Oil can flow under pressure out of the central channel 30 along the rotation axis 27, in particular since the bolt 26 is divided and split into a first bolt part 26*a* and a second bolt part 26*b*, so that the central channel 30 is formed continuously and is not interrupted by a bolt 26 passing through. The oil can thus be transferred from the central channel 30 into a gap between the bolt parts 26*a*, 26*b* and the bore in which the bolt parts 26*a*, 26*b* are made in the inner shaft 12, to reach the gap 25 and, for example via a passage 22 and an oil groove 16, lubricate the seat of the second cam 13 on the outer shaft 10 and be distributed further below the cam 13 through the bolt opening 23.

Figure 13A:
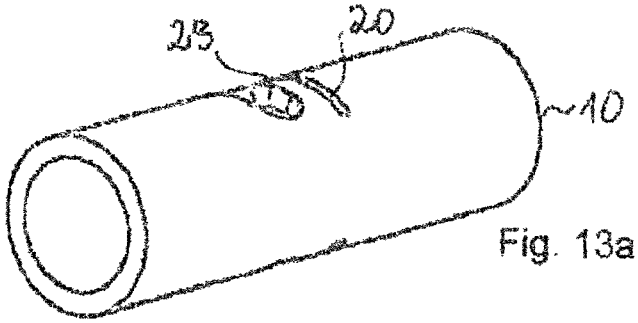
FIG. 13*a* is a perspective view of an alternate embodiment of an outer shaft of the present disclosure having an oil groove defined therein that runs in a circumferential direction and extends over a partial periphery of the outer shaft.
Figure 13B:
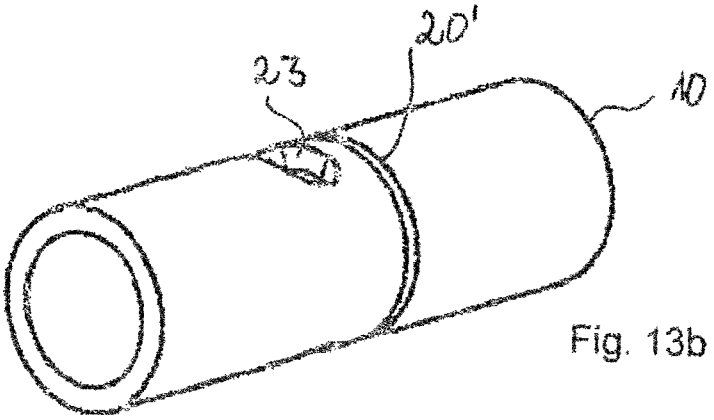
FIG. 13*b* is a perspective view of an alternate embodiment of an outer shaft of the present disclosure, having an oil groove defined therein that runs in a circumferential direction and fully surrounds the outer shaft.

FIGS. 13*a* and 13*b* show as an example an outer shaft 10 with a bolt opening 23, wherein in FIG. 13*a* an oil groove 20 is produced adjacent to the bolt opening 23 in the outside of the outer shaft 10, which according to the arrangement in FIG. 11 can be supplied with oil via an oil groove 18. The oil groove 20 extends over a partial circumference of the outer shaft 10. FIG. 13*b* shows an outer shaft 10 with an oil groove 20' which runs over the full circumference of the outer shaft 10 and can be supplied with pressure oil via the oil groove 18 in the same way as shown in FIG. 11.

The invention is not restricted in its embodiments to the exemplary embodiments described above as preferable. Rather a number of variants are conceivable which in principle use the solution presented even in fundamentally different designs. All features and/or advantages arising from the claims, description or drawings, including constructional details or spatial arrangements, may be essential to the invention both alone and in any varying combination. For example the circumferential oil grooves 20, 20' and 21 shown in FIGS. 9, 10*c*, 11, 13*a* and 13*b* can be combined with designs of the oil groove 16 and/or 17 as shown as examples in FIGS. 1 to 8.

The invention claimed is:

1. An adjustable camshaft for a valve gear of an internal combustion engine, comprising:

a tubular outer shaft defining an open passage extending through a wall thereof;

at least one first cam disposed on, and coupled to, said outer shaft so as to prevent rotational movement of said first cam with respect to said outer shaft;

an inner shaft extending through an interior of said tubular outer shaft, said inner and outer shafts being rotatable with respect to one another about a longitudinal rotation axis;

at least one second cam having a cam bore defined there through and coupled to said inner shaft so as to prevent rotational movement of said second cam with respect to said inner shaft, said at least one second cam further being rotatably mounted through said cam bore onto an outer surface of said outer shaft at a seating point thereof;

at least one oil groove defined in at least one of an outer surface of said outer shaft or an inner surface of said cam bore of said second cam, at a location of said seating point on said outer shaft;

a peripheral gap defined between said outer shaft and said inner shaft, said peripheral gap configured to permit oil to flow between said outer shaft and said inner shaft to said open passage in said wall of said outer shaft, through said open passage, and into said at least one oil groove, so as to provide lubrication between said at least one second cam and said outer shaft upon rotational movement there between.

2. The adjustable camshaft of claim 1, wherein said at least one second cam is coupled to said inner shaft by a bolt that extends through at least one bolt opening defined in said outer shaft, and wherein said open passage through said wall of said outer shaft is formed by said bolt opening.

3. The adjustable camshaft of claim 1, wherein said at least one oil groove defined in said outer surface of said outer shaft is in fluid communication with said open passage.

4. The adjustable camshaft of claim 1, wherein said at least one oil groove defined in said inner surface of said cam bore of said second cam extends at least partly beyond said bolt opening and is in fluid communication with said open passage.

5. The adjustable camshaft of claim 2, wherein said oil groove is formed as a widened part of said bolt opening.

6. The adjustable camshaft of claim 1, wherein said oil groove extends in at least one of a direction that is parallel to said rotation axis or oblique to said rotation axis.

7. The adjustable camshaft of claim 1, further comprising:

a first oil groove defined in at least one of an outer surface of said outer shaft or an inner surface of said cam bore of said second cam that extends in at least one of a direction that is parallel to said rotation axis or oblique to said rotation axis; and a second oil groove defined in at least one of an outer surface of said outer shaft or an inner surface of said cam bore of said second cam that extends in a circumferential direction, wherein said first oil groove and said second oil groove are in fluid communication with each other.

8. The adjustable camshaft of claim 1, wherein said outer shaft and said inner shaft are configured to permit pressure oil to be forced into said gap between said outer shaft and said inner shaft so as to run in said gap in a direction parallel to said rotation axis.

9. The adjustable camshaft of claim 1, wherein said inner shaft further defines therein a central bore extending parallel to and through said rotation axis, and further defines at least one radial through-channel extending from said central bore outward through a wall of said inner shaft to connect to said peripheral gap, and wherein said inner shaft is configured to permit pressure oil to be forced through said central bore in said inner shaft, through said radial through-channel, and into said peripheral gap between said outer shaft and said inner shaft.

10. The adjustable camshaft of claim 1, wherein said second cam has a cam collar, wherein said oil groove extends at least partly into said cam collar.

* * * * *